United States Patent [19]

Loveder

[11] Patent Number: 4,972,613

[45] Date of Patent: Nov. 27, 1990

[54] REAR ENTRY ATHLETIC SHOE

[75] Inventor: Christopher J. Loveder, Rockford, Mich.

[73] Assignee: Wolverine World Wide, Inc., Rockford, Mich.

[21] Appl. No.: 419,526

[22] Filed: Oct. 10, 1989

[51] Int. Cl.[5] ..... A43B 11/00; A43B 21/00

[52] U.S. Cl. ..... 36/105; 36/50; 36/114

[58] Field of Search ..... 36/105, 89, 99, 114, 36/50, 54, 58.5, 58.6

[56] References Cited

U.S. PATENT DOCUMENTS

| | | | |
|---|---|---|---|
| 459,616 | 9/1891 | Van Rohonczy . | |
| 1,155,506 | 10/1915 | Osaki . | |
| 1,861,299 | 5/1932 | Bullock | 36/50 |
| 2,420,239 | 5/1947 | Hack | 36/50 |
| 2,736,110 | 2/1956 | Hardimon | 36/58.5 |
| 2,763,071 | 9/1956 | Napier | 36/8.5 |
| 3,192,651 | 7/1965 | Smith | 36/2.5 |
| 4,073,073 | 2/1978 | Siedel | 36/50 |
| 4,095,356 | 6/1978 | Robran | 36/121 |
| 4,107,856 | 8/1978 | Bourque | 36/115 |
| 4,236,328 | 12/1980 | Friedlander | 36/58.5 |
| 4,280,286 | 7/1981 | Sartor | 36/118 |
| 4,547,981 | 10/1985 | Thais | 36/89 |
| 4,559,722 | 12/1985 | Norton | 36/105 |
| 4,577,419 | 3/1986 | Chassaing | 36/89 |
| 4,662,088 | 5/1987 | Autry et al. | 36/105 |
| 4,761,898 | 8/1988 | Courvoisier | 36/50 |
| 4,776,111 | 10/1988 | Crowley | 36/89 |
| 4,813,668 | 3/1989 | Solloway | 36/105 |

*Primary Examiner*—Steven N. Meyers

*Attorney, Agent, or Firm*—Price, Heneveld, Cooper, DeWitt & Litton

[57] ABSTRACT

A high top athletic shoe has partial quarters terminating in spaced relationship to each other, in combination with a rear subassembly with inner and outer portions. The inner portion includes a substantially rigid lower counter portion and a soft, flexible Y-shaped upper rear portion forming a tendon engager, integral with but movable relative to the lower portion for flexing thereof between a forward foot-engaging position and a rearward foot entry position. The outer portion comprises a relatively rigid, U-support element pivotally mounted on both sides of the shoe, and movable between a lowered position beneath the counterpoint of the foot and spaced rearwardly of the inner portion, and an upper position snugly engaging the inner portion being retained in this latter condition by a connectable tensile strap extending around the U-support at the rear of the shoe.

10 Claims, 3 Drawing Sheets

REAR ENTRY ATHLETIC SHOE

BACKGROUND OF THE INVENTION

Athletic footwear construction has been revolutionized in recent decades. Athletic shoes for activities such as running, tennis, basketball, etc., particularly high top shoes, constitute specialty items different from footwear for other uses. They typically incorporate features that secure the shoes snugly to the feet, providing support for the particular activity Consequently, putting high top athletic footwear on the feet can be laborious and time consuming. It would be advantageous to have easy entry athletic high top footwear to enable easy and quick application and removal. However, such footwear must still have proper support features. Various types of easy entry rigid ski boots have been taught in U.S. Pat. Nos. 4,761,898; 4,095,356; 4,280,286; and 4,107,856; and rear entry low top shoes have been taught in U.S. Pat. Nos. 2,736,110 and 3,192,651. Yet, as far as is known, no one has devised athletic high top shoes capable of rear entry and of providing proper support when worn, so that after applied to the feet, they effectively supply the support important for containing the stresses applied during sports activities.

SUMMARY OF THE INVENTION

This invention relates to rear entry athletic footwear, and more particularly to novel high top rear entry athletic shoes.

This invention enables entry from the top and rear of the shoe without disrupting the function of the specialized shoe construction for the particular athletic activity. The novel high top shoe has partial quarters terminating in spaced relationship to each other, in combination with a rear subassembly with special inner and outer portions. The inner portion includes a substantially rigid lower counter portion and a soft, flexible Y-shaped upper rear portion forming a tendon engager, integral with but movable relative to the lower portion for flexing thereof between a forward foot-engaging position and a rearward foot entry position. This upper portion overlaps the spaced partial quarters which are forwardly thereof. The outer portion comprises a relatively rigid, horseshoe shaped retention and reinforcing, U-support element pivotally mounted on both sides of the shoe, and movable between a lowered position beneath the counterpoint of the foot and spaced rearwardly of the inner portion, and an upper position, snugly engaging the inner portion, being retained in this latter condition by a connectable tensile strap extending around the U-support at the rear of the shoe.

DESCRIPTION OF THE PREFERRED EMBODIMENTS

Figure 1:
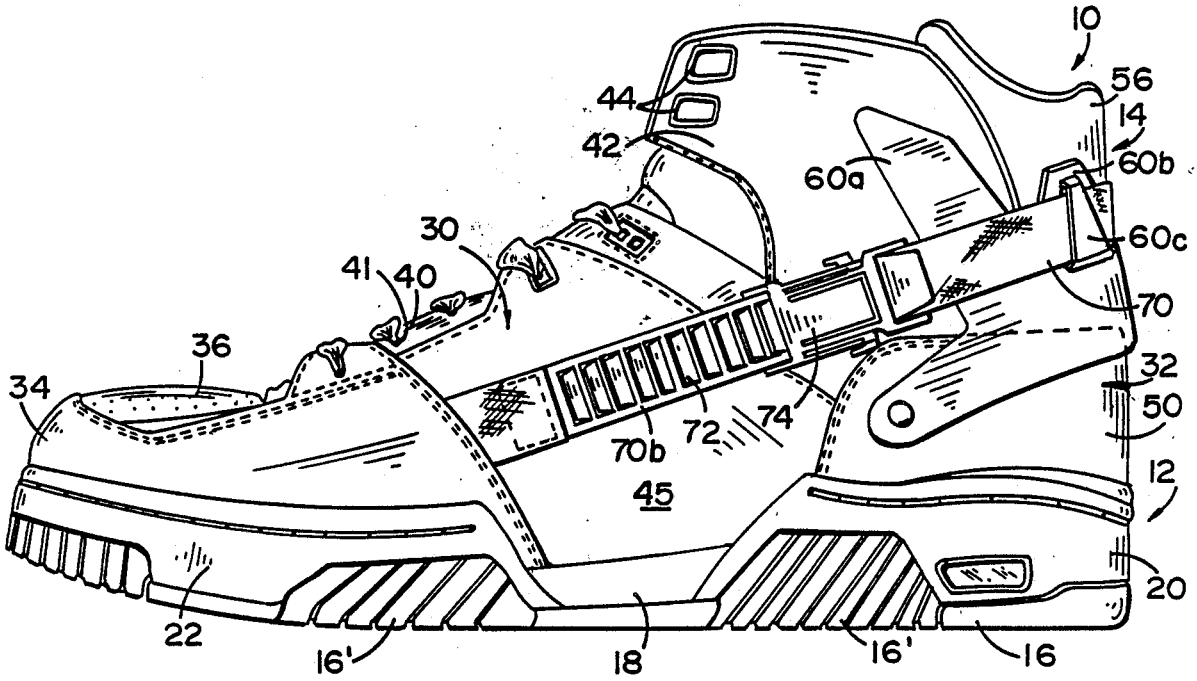
FIG. 1 is a side elevational view of a preferred form of the invention depicting the lateral side of a left shoe.

Referring now specifically to the drawings, the high top athletic shoe 10 there depicted includes a sole assembly 12 and an upper assembly 14. This sole assembly will typically include an outsole 16 on the bottom of the shoe for engagement of the surface such as the ground, a floor, or the like, and be formed of abrasion resistant material such as rubber or other polymer. A midsole 18 is above the outsole and bonded thereto. This midsole may be formed of any desired material for shock absorption and foot roll control, e.g., ethylene vinyl acetate foam or the like, with or without added fluid chambers. Typically, an insole (not shown) is above the midsole and attached thereto. Optionally, a sock liner of cloth or the like is positioned above the insole for engagement with the foot. This sole assembly may also include a wrap around, heel bumper strip 20, and a wrap around, toe bumper strip 22 as of rubber. In the embodiment depicted, the outsole 16 has portions of its tread wrapped around the sides of the shoe at 16'. This sole assembly can be modified in various ways depending upon the particular usage intended for the footwear.

Upper assembly 14 is attached to the sole assembly by stitching and bonding. Upper assembly 14 includes a frontal subassembly 30 and a rear subassembly 32. Frontal subassembly 30 includes a toe box 34, a vamp 36 attached to the toe box, a throat 38 (FIG. 4), and a pair of throat straddling eyestays 40. A tongue 39 extends vertically in the throat, and has an inner padding **39*a*. The frontal subassembly also includes a pair of special partial quarters 42 which extend upwardly to form partial collars at the upper part of the shoe and which terminate at rear edges 42' (FIGS. 1 and 6) spaced from each other. Adjacent the front edges of the partial quarters are lace receiving openings 44. These openings are generally in alignment with the series of lace receiving openings 41 in eyestays 40**, along both sides of the throat. These front edges of these partial quarters are spaced from each other across the throat of the shoe, while the rear edges thereof are spaced from each other across the Achilles tendon or rear panel area of the shoe. Thus, the partial quarters extend along the ankle bone on the medial and lateral sides of the shoe. They have padding on the inner surfaces thereof.

Preferably, a leather reinforcement cinch 45 is integrally connected to the frontal subassembly to form a part thereof, such extending up from the sole assembly on both sides of the shoe to cross over the instep region of the foot for added support when tied together by the laces.

Figure 3:
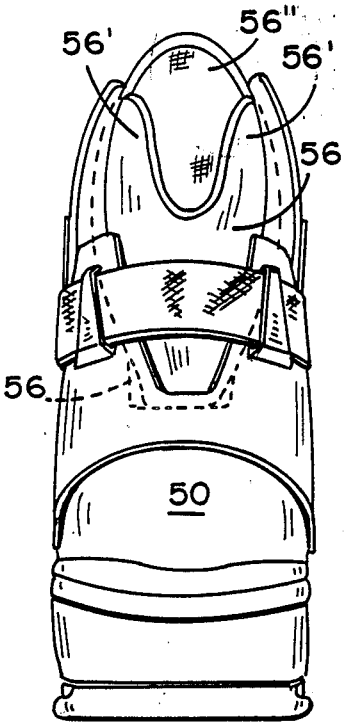
FIG. 3 is a rear elevational view of the shoe in FIGS. 1 and 2.
Figure 4:
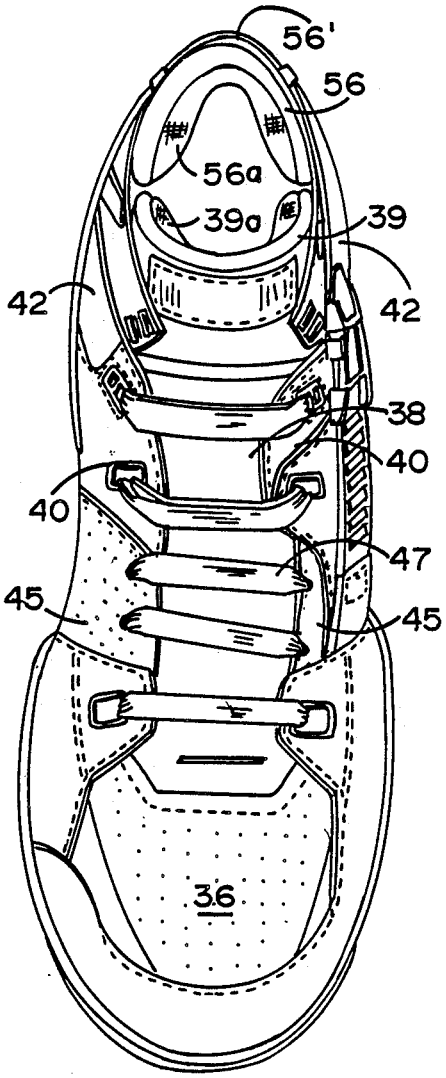
FIG. 4 is a top plan view of the shoe in FIGS. 1–3.

Cooperative with frontal subassembly 30 is the rear subassembly 32 as noted previously. This rear subassembly includes an inner portion and an outer portion. The inner portion includes a rigid lower counter 50 at the heel in the lower portion of the shoe upper (FIGS. 1 and 3), being of generally arcuate configuration, being secured at the bottom edge thereof to the sole adjacent the outer periphery of the sole, and being secured to the frontal portion of the shoe as by stitching and/or bonding. This counter is generally rigid and of arcuate shape, to extend around the lower portion of the foot adjacent the heel below the counterpoint. As is well known, the counterpoint of the foot and shoe is that small vertical area, approximately one-quarter inch wide at the Achilles tendon above the heel of the foot where the foot recesses forwardly and where the rear of the shoe is typically sloped forwardly to be held onto the foot. The counter 50 of the present shoe terminates below this counterpoint so that, although it supports the foot against lateral and rearward movement off the sole assembly, it does not of itself vertically hold the shoe on the foot. Immediately above the counter and attached thereto at its lower edge as by stitching is a generally Y-shaped, soft, flexible, upper, rear Achilles tendon engager 56 which, from the rear, appears as in FIG. 8 and FIG. 3 (partially by dashed lines). That is, tendon engager 56 has a pair of upper ears 56' extending and diverging upwardly outwardly, forming a vertical cavity 56'' therebetween for comfort at the Achilles tendon. It is preferably of a soft flexible leather with an interior lining **56*a* of padding and cloth (FIG. 4). This flexible tendon engager can be shifted rearwardly about its lower edge stitching to the counter, by finger or thumb pressure simultaneously with forward shifting of the shoe tongue by the opposite hand as illustrated, for example, in FIG. 7**, provided that the outer portion now to be described is previously shifted downwardly-rearwardly.

Figure 8:
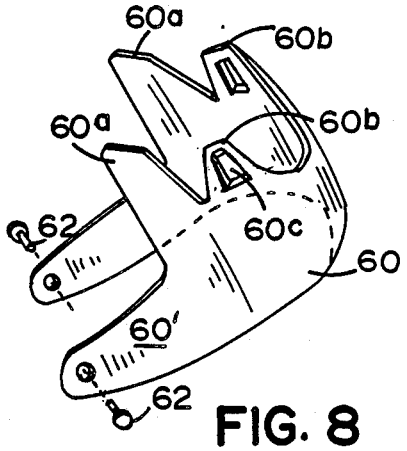
FIG. 8 is a perspective view of the U-support shown separated from the shoe for clarity.
Figure 9:
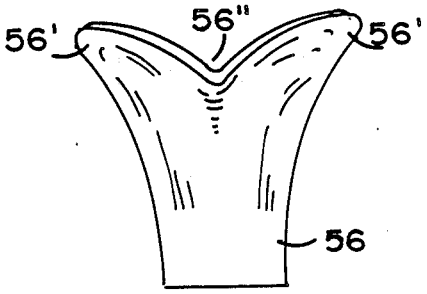
FIG. 9 is a rear elevational view of the tendon engager shown separated from the shoe for clarity.

More specifically, outer portion 60 comprises a generally rigid member of U-shape forming a forwardly open U-support (see FIG. 8). The forward ends 60' of the two legs of the U are pivotally attached to the forward portions of counter 50 by aligned rivets 62 (FIGS. 5 and 6) just above the sole assembly, so that a pivot axis at these rivets, transverse to the longitudinal dimension of the shoe, is below the level of the counterpoint of the shoe/foot. This U-support includes special upstanding projections, four in number in the form depicted, two like projections being identified with the numeral **60*a*, and two other like projections being identified with the numeral 60*b*. Integral upstanding outer projections or wings 60*a* are adapted when elevated to engage the partial quarters 42 above the level of the counterpoint to lend lateral reinforcement thereto when the U-support is in its upward/forward position (see FIGS. 1 and 2). Integral upstanding central projections or arms 60*b* are adapted to bear against the sides of tendon engager 56 above the level of the counterpoint when the U-support is in its upward/forward position. Arms 60*b* are spaced from each other behind tendon engager 56** to add rear support astraddle of the Achilles tendon and help retain the shoe on the foot.

Figure 2:
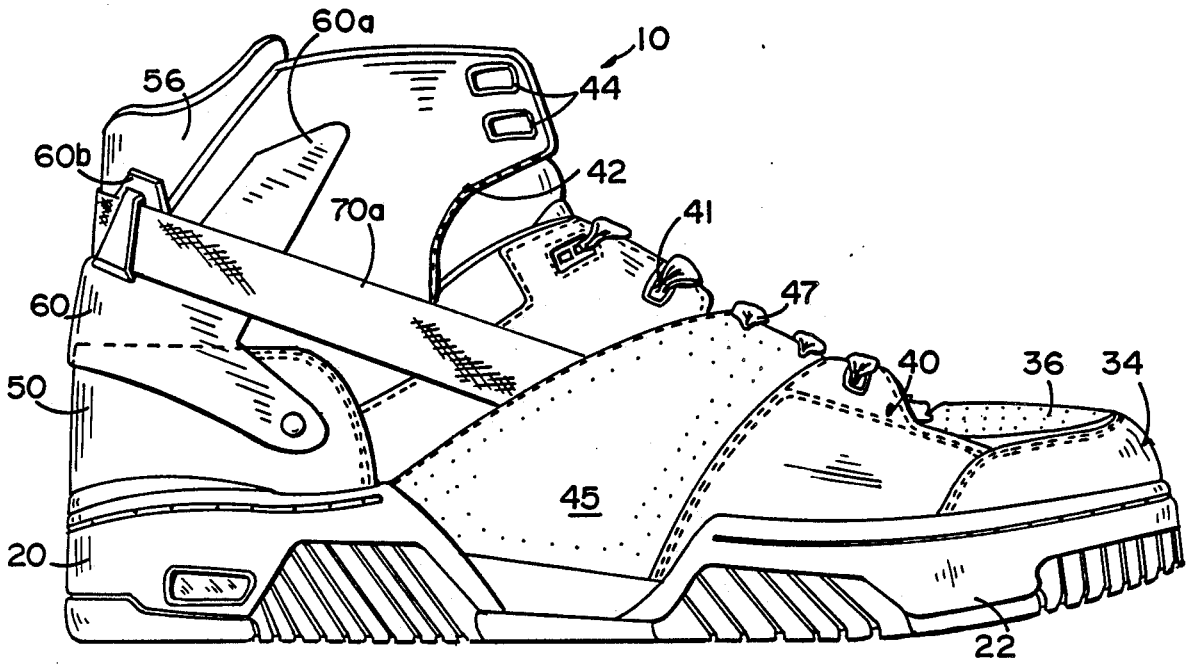
FIG. 2 is a side elevational view of the shoe in FIG. 1, depicting the medial side.
Figure 5:
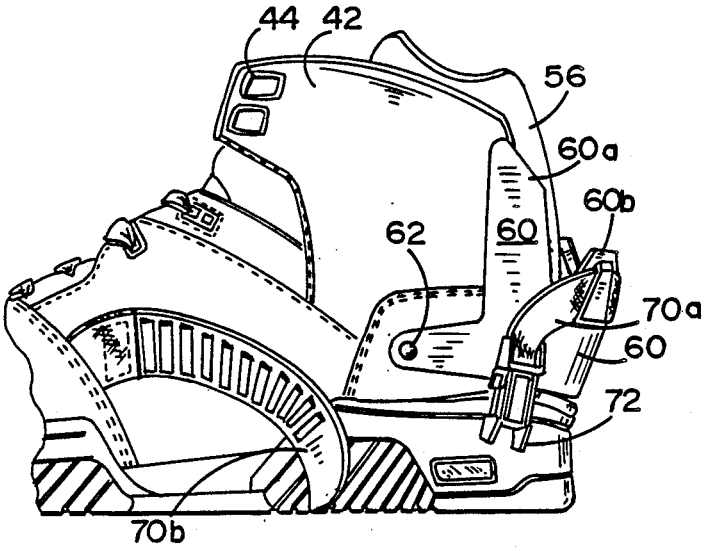
FIG. 5 is a fragmentary side elevational view of the lateral side of the shoe with the U-support released and lowered.
Figure 6:
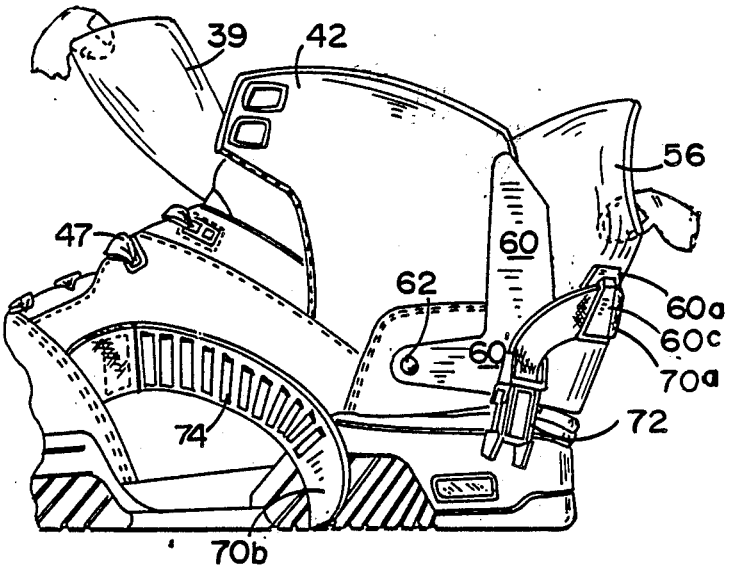
FIG. 6 is a fragmentary side elevational view like FIG. 5, but with the shoe opened for entry by flexing the tongue forwardly and flexing the soft tendon engager rearwardly and downwardly.

This U-support 60 can be pivotally shifted between the upper forward position illustrated in FIGS. 1 and 2, and the lowered rearward position depicted in FIGS. 5 and 6. In this lowered condition, wings **60*a* and arms 60*b* are spaced from the shoe upper, downwardly rearwardly thereof, i.e., out of engagement with the partial quarters and the tendon engager. In the elevated forward position of support 60, the main body of the support abuts the upper part of counter 50 below the counterpoint so as not to apply direct pressure to the Achilles tendon of the foot. However, the projections all extend above the level of the counterpoint. Retention of the U-support in its elevated position is achieved by a tensile binding strap which is shown in two parts 70*a* and 70*b* having connectors thereon, here shown to be ratchet teeth on one strap and a ratchet buckle on the other strap. The forward ends of these two straps are stitched to the frontal portion of the shoe, preferably to reinforcing cinch 45, and extend rearwardly. One of the straps extends around the heel through loops 60*c* on arms 60*b* of U-support 60 (FIGS. 1 and 6). Strap 70*b* is shown to have a series of ratchet teeth 74 engageable or disengageable from ratchet buckle 72** for controlled adjustment tightening. The buckle may alternatively be mounted on the short strap rather than on the long one as shown, with the ratchet elements on the long strap rather than the short one. Further, in some types of athletic shoes, it is preferable to employ a hook and loop fastener, e.g., "Velcro" brand, instead of the ratchet arrangement depicted. Either type enables a controlled amount of tension to be applied to the strap, for achieving a controlled amount of forward force on the rear subassembly.

Figure 7:
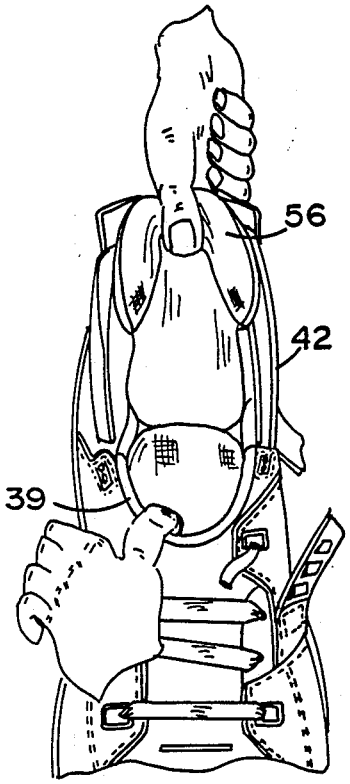
FIG. 7 is a top view of the opened shoe in FIG. 6.

In use, the shoe is readily applied to the foot, or removed therefrom. When applied and fastened, it affords excellent support to the foot. More specifically, to place the shoe on the foot, the laces are loosened from the eyelets of the eyestays and partial quarters, the fastener strap is unfastened and the U-support 60 lowered on its pivot axis. The tongue is pulled forwardly into the throat of the shoe, while simultaneously the soft flexible tendon engager 56 is pulled rearwardly as depicted in FIG. 7. This allows rear entry, or more specifically top and rear entry of the foot into the enlarged space receiving it. After the foot is in the shoe, the wearer then causes the tongue and tendon engager to move back against the front and rear of the foot, respectively. Thereafter, the laces are tightened and tied, padded tendon engager 56 is checked to assure overlap of its ears 60 inside partial quarters 42, and U-support 60 is pivoted on its rivets 62 upwardly and forwardly until the lower part of this support engages the top portion of counter 50, with arms **60*b* in engagement with both sides of tendon engager member 56 and wings 60*a* in engagement with partial quarters 42. Strap 70, and particularly its two components 70*a* and 70*b***, are then interconnected as with the buckle and ratchet shown or, for example, the alternative hook and loop fastener, and pulled to the desired degree of tension to combine the rear subassembly and frontal subassembly into the upper assembly. The shoe is then ready for action.

Removal of the shoe involves a reversal of these steps. Conceivably, those in the footwear art will, after studying this disclosure, consider alternative embodiments to the exemplary ones described to suit particular activities. It is intended that the invention not be limited to the preferred described embodiments, but only by the claims to follow and the equivalents thereto.

The embodiments of the invention in which an exclusive property or privilege is claimed are defined as follows.

1. An easy entry high top athletic shoe comprising:

a sole assembly and an upper assembly;

said upper assembly comprising a frontal subassembly and a rear subassembly;

said frontal subassembly having a toe box, a throat with eyestays, and a pair of partial quarters in spaced relationship to each other;

said rear subassembly having an inner portion and an outer portion;

said inner portion including a generally rigid lower counter of arcuate shape secured to said frontal assembly and to said sole assembly, and including a soft, flexible, upper, rear, Achilles tendon engager secured to said counter and overlapping said partial quarters;

said outer portion comprising a generally rigid U-support pivotally attached to said counter on opposite sides of said shoe and pivotally movable between a lower position below the counterpoint and spaced from said tendon engager and an upper position against said tendon engager; and U-support retention means for retaining said U-support in said upper position.

2. The high top shoe in claim 1 wherein said tendon engager has a pair of upstanding ears overlapping the inside of said partial quarters.

3. The high top shoe in claim 2 wherein said tendon engager has a generally U-shaped configuration.

4. The high top shoe in claim 1 wherein said U-support has vertical projections on both sides thereof engaging said partial quarters when said U-support is in said upper position.

5. The high top shoe in claim 4 wherein said U-support includes other vertical projections on both sides thereof engaging said tendon engager when said U-support is in said upper position.

6. The high top shoe in claim 1 wherein said U-support retention means comprises fastenable tensile means extending from said frontal portion around said U-support.

7. The high top shoe in claim 6 wherein said tensile means comprises a pair of connectable straps.

8. A rear entry athletic shoe comprising:

a sole assembly;

an upper assembly including a frontal subassembly and an overlapping rear subassembly;

said frontal subassembly having a toe box and a pair of partial quarters at the ankle region of the shoe;

said rear subassembly extending around the heel of the shoe and having a lower counter and an upper flexible member attached to said counter;

said rear subassembly also having a shiftable U-support around said counter and on a pivot axis transverse to the longitudinal dimension of the shoe and adjacent said sole assembly, said pivotal U-support being pivotally shiftable on said axis between an upward forward position in supporting engagement with said flexible member, and a rearward downward position;

said upper flexible member being movable on said counter between a first position extending toward said partial quarters to enclose a foot, and a second position flexed rearwardly and away from said front portion for foot entry or removal; and a retainer between said U-support element and said front portion, engageable when said flexible member is in said first position to cause said U-support element to hold said flexible member against a foot.

9. The athletic shoe in claim 8 wherein said U-support comprises a generally stiff arcuate member pivotally connected at the forward ends thereof to said counter adjacent said sole assembly, and said retainer comprises interconnectable strap means attached to said frontal subassembly and around said arcuate member for retaining said rear subassembly in forward position.

10. The athletic shoe in claim 8 wherein said rear subassembly comprises inner and outer portions, said inner portion being said flexible member for engagement with the wearer's foot and shiftable from a first position overlapping the Achilles tendon of the foot to a second position shifted away from the Achilles tendon to thereby enlarge the foot receptive opening;

and said outer portion comprising said U-support pivotally attached at its ends to said counter, said U-support having upward projections for engaging said rear assembly inner portion, and having upward projections for engaging said partial quarters.

* * * * *